US007966779B1

(12) United States Patent
Horvath

(10) Patent No.: US 7,966,779 B1
(45) Date of Patent: Jun. 28, 2011

(54) GREEN ROOF ASSEMBLY FOR INHIBITING WIND EROSION AND METHOD OF INSTALLATION

(75) Inventor: Kurt Z. Horvath, Glenview, IL (US)

(73) Assignee: Green Roof Solutions, Inc., Glenview, IL (US)

( * ) Notice: Subject to any disclaimer, the term of this patent is extended or adjusted under 35 U.S.C. 154(b) by 1568 days.

(21) Appl. No.: 11/065,956

(22) Filed: Feb. 25, 2005

(51) Int. Cl.
*E02D 17/20* (2006.01)
*E02D 5/54* (2006.01)

(52) U.S. Cl. ..... 52/156; 52/166; 52/163; 52/4; 405/244; 405/302.4; 405/302.6

(58) Field of Classification Search ..... 52/155, 52/166, 163, 103, 156, 162, 4, 118, 102, 52/DIG. 7, 410; 47/65.9, 66.1, 56, 86; 405/21, 405/19, 16, 29, 455, 15, 244, 232, 302.4, 405/302.6, 302.7
See application file for complete search history.

(56) References Cited

U.S. PATENT DOCUMENTS 2,923,093 A * 2/1960 Allen ..... 47/56
3,378,975 A * 4/1968 Hill ..... 52/508
3,432,977 A * 3/1969 Scholl ..... 52/98
4,288,951 A * 9/1981 Carlson et al. ..... 52/94
4,534,142 A * 8/1985 Drefahl ..... 52/90.2
4,842,465 A * 6/1989 Pease et al. ..... 411/337
4,993,870 A * 2/1991 Bridgewater ..... 405/21
5,155,934 A * 10/1992 Leider ..... 47/86
5,175,966 A 1/1993 Remke et al.
5,322,386 A * 6/1994 Trangsrud ..... 405/19
5,358,356 A 10/1994 Romanek et al.
5,426,905 A * 6/1995 Rollhauser et al. ..... 52/512
5,529,451 A * 6/1996 Bruins et al. ..... 411/482
5,553,368 A * 9/1996 Barry ..... 29/423
5,557,897 A * 9/1996 Kranz et al. ..... 52/410
5,890,842 A * 4/1999 Dahill ..... 405/244
6,171,022 B1 * 1/2001 Decker ..... 405/16
6,178,690 B1 1/2001 Yoshida et al.
6,237,285 B1 5/2001 Yoshida et al.
6,349,514 B1 2/2002 Adams
6,443,667 B2 9/2002 Brown
6,524,027 B1 * 2/2003 Fabius ..... 405/16
6,527,407 B2 * 3/2003 Gluck ..... 362/153.1

(Continued)

OTHER PUBLICATIONS http://web.archive.org/web/20031002133747/www.roofmeadow.com/products.html.*

(Continued)

*Primary Examiner* — Eileen Lillis
*Assistant Examiner* — Alp Akbasli
(74) *Attorney, Agent, or Firm* — George Pappas

(57) ABSTRACT

An assembly for inhibiting wind erosion including an anchorage structure, an erosion mat and a retaining member. The anchorage structure includes a downwardly facing base surface, an upwardly facing anchorage surface, and a rigid elongate member. The anchorage structure is supportable on its base surface with the elongate member in an upright position. The anchorage structure is disposed within a plant growing medium with the elongate member extending upwardly through the erosion mat. A retaining member is secured to the elongate member and engages the upwardly facing surface of the erosion mat to inhibit the removal of the erosion mat. The assembly can be used in a green roof system by placing a drainage layer on the roof and a filter fabric between the plant growing medium and the drainage layer. The anchorage structure is positioned above the filter fabric.

13 Claims, 3 Drawing Sheets

U.S. PATENT DOCUMENTS

| | | | | |
|---|---|---|---|---|
| 6,571,518 | B1 * | 6/2003 | Barley | 52/223.13 |
| 6,663,324 | B2 | 12/2003 | Nordloh | |
| 6,711,851 | B2 | 3/2004 | Mischo | |
| 6,862,842 | B2 * | 3/2005 | Mischo | 47/65.9 |
| 7,207,742 | B2 * | 4/2007 | Prevost | 404/71 |
| 7,708,502 | B2 * | 5/2010 | Carte et al. | 405/302.4 |
| 7,862,259 | B2 * | 1/2011 | Carpenter | 405/302.7 |
| 2001/0045068 | A1 * | 11/2001 | Chalich | 52/157 |
| 2002/0007591 | A1 | 1/2002 | Mischo | |
| 2002/0007592 | A1 | 1/2002 | Mischo | |
| 2002/0007593 | A1 | 1/2002 | Mischo | |

OTHER PUBLICATIONS http://www.aadl.org/gallery/aadlbuildings/malletts/completed+job+02.JPG.html?g2_imageViewsIndex=0.*

* cited by examiner

GREEN ROOF ASSEMBLY FOR INHIBITING WIND EROSION AND METHOD OF INSTALLATION

BACKGROUND OF THE INVENTION

1. Field of the Invention

The present invention relates to assemblies for inhibiting wind erosion and, more particularly, such an assembly that can be installed as part of a green roof system.

2. Description of the Related Art

Various materials are known which can be placed over a ground surface to inhibit wind erosion and/or other forms of erosion. Typically, such erosion mats are formed of fabric or film materials that can be commercially obtained on relatively large rolls. During installation, the erosion mat is unrolled onto the ground surface to be protected and then secured in place. When such erosion mats are installed on a natural ground surface, spikes or similar anchoring devices can be driven through the erosion mat from above into the ground to thereby hold the material in place on the ground surface.

Such erosion mats are also employed with green roof systems. A variety of green roof systems are known in the art. For example, modular green roof systems are described in U.S. Pat. Nos. 6,178,690 B1 (Yoshida et al.); 6,237,285 B1 (Yoshida et al.); and 6,711,851 B2 (Mischo) the disclosures of which are expressly incorporated herein by reference. Non-modular green roof systems are also known and can be used to economically cover large rooftop expanses. In such non-modular systems, it is typical to install a drainage layer on the roof structure in the area of the green roof system. A filter fabric is then placed over the drainage layer and an engineered soil or other plant growing medium is installed over the filter fabric. It is also often necessary to install a wind erosion mat to cover the upper surface of the soil layer. The need for a wind erosion mat can be particularly acute for a green roof system installed on a tall building in an urban area where the system will be subjected to high winds and it is desirable to prevent debris, such as small stones, from falling from the roof.

In a conventional non-modular green roof system, the depth and consistency of the soil layer will generally not be sufficient to secure an erosion mat in the same manner as in the soil of a natural ground surface. Moreover, the use of spikes or similar anchoring mechanisms in a green roof system can potentially damage the underlying roof structure and water barriers if the spikes are driven to far into the soil layer. Instead, it is typical for an additional layer of felt, a moisture retention fabric or other similar material to be laid down directly on top of the filter fabric to facilitate the attachment of the erosion mat. At spaced intervals where it is desired to secure the erosion mat, two small spaced apart slits are cut into the felt layer. A zip tie (such as those commonly used when securing electrical wires), a short length of wire, a twist tie or similar fastening device is manually threaded through the slits at each spaced interval. The soil layer is then placed over the felt and filter fabric layers. The zip ties must then be relocated and positioned so that they extend above the upper surface of the soil layer. The erosion mat is then unrolled over the soil layer and the two projecting ends of each of the zip ties must be manually threaded through the erosion mat at spaced apart locations and secured together to thereby fasten the erosion mat to the felt layer.

While effective, this method of installing an erosion mat in a green roof system is very labor intensive and, as a result, can be quite expensive.

SUMMARY OF THE INVENTION

The present invention provides an assembly that can be used to effectively anchor a wind erosion mat, is well adapted for use with green roof systems and can be efficiently installed.

The invention comprises, in one form thereof, an anchorage for a green roof system wherein the green roof system has an erosion mat overlaying a material layer. The anchorage includes an anchorage structure having an anchorage surface and a rigid elongate member. The anchorage structure is adapted for installation in the material layer with the anchorage surface being overlain by the material layer whereby the anchorage surface inhibits the upward displacement of the anchorage structure and with the elongate member projecting upwardly through the erosion mat. A retaining member is securable to the elongate member to thereby engage and hold down the erosion mat.

The invention comprises, in another form thereof, a green roof assembly for inhibiting wind erosion that has a material layer that includes a plant growing medium, an erosion mat overlaying the material layer, an anchorage structure and a retaining member. The anchorage structure has an anchorage surface and a rigid elongate member. The anchorage surface is disposed within the material layer and inhibits upward displacement of the anchorage structure by engagement with the material layer. The elongate member extends out of the material layer and through the erosion mat. The retaining member is secured to the elongate member and engages the erosion mat.

The assembly can be installed on a roof structure and may include a drainage layer disposed vertically above the roof structure with a filter fabric located between the drainage layer and the material layer. The anchorage structure may include a base member that defines the anchorage surface. The anchorage structure is positioned above the filter fabric in the material layer with the base member positioned proximate the filter fabric and the elongate member extending vertically above the upper surface of the material layer through the erosion mat. The retaining member engages the upper surface of the erosion mat to thereby hold the erosion mat on the upper surface of the material layer.

The invention comprises, in still another form thereof, a method of installing a green roof system on a roof structure. The method includes positioning a material layer including a plant growing medium on the roof structure and providing at least one anchorage structure having an anchorage surface and a rigid elongate member. The anchorage structure is positioned within the material layer with the elongate member projecting above an upper surface of the material layer. The material layer overlays the anchorage surface and thereby inhibits the upward displacement of the anchorage structure. An erosion mat is positioned on the upper surface of the material layer proximate the anchorage structure with the elongate member extending through the erosion mat. A retaining member is secured to the elongate member and engages the erosion mat to thereby inhibit the removal of the erosion mat from the upper surface of the material layer.

An advantage of the present invention is that it provides an assembly for securing an erosion mat that can be efficiently installed without an excessive amount of labor and that is well-suited for use in a green roof system.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
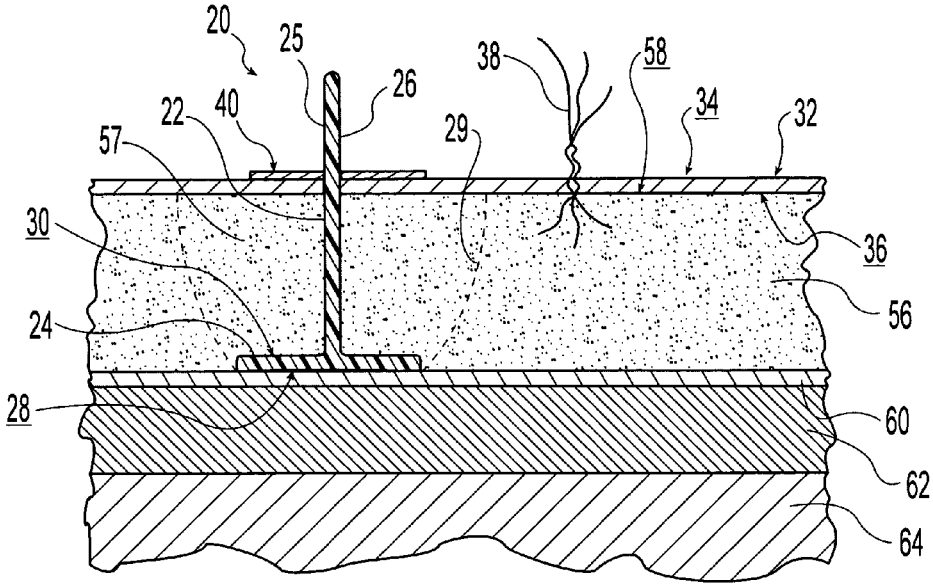
FIG. 1 is a sectional view of an assembly in accordance with the present invention.

Corresponding reference characters indicate corresponding parts throughout the several views. Although the exemplification set out herein illustrates the invention in several forms, the embodiments disclosed below are not intended to be exhaustive or to be construed as limiting the scope of the invention to the precise forms disclosed.

DETAILED DESCRIPTION OF THE INVENTION

Figure 3:
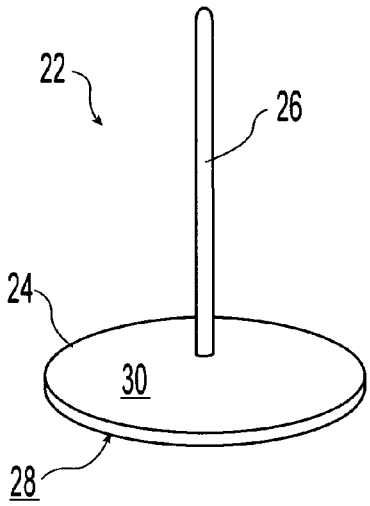
FIG. 3 is a perspective view of an anchorage structure used in the assembly of FIG. 1.
Figure 4:
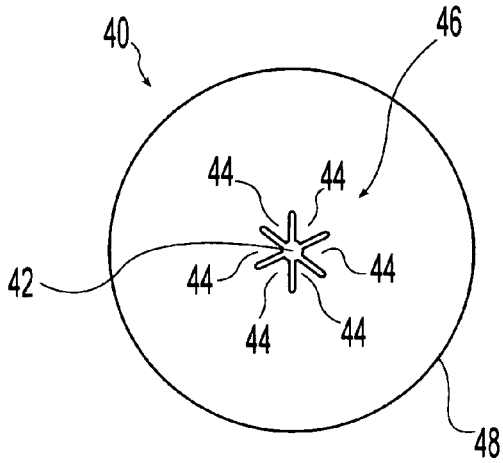
FIG. 4 is a top view of a retaining member used in the assembly of FIG. 1.

An assembly 20 for securing an erosion mat in accordance with the present invention is shown in FIG. 1. The assembly 20 includes an anchorage structure 22 which is also shown in FIG. 3. The anchorage structure 22 includes a base member 24 and rigid elongate member 26. Anchorage structure 22 includes a downwardly facing base surface 28 and an upwardly facing anchorage surface 30. Anchorage structure 22 is configured so that when base surface 28 is rested on a generally horizontal surface to support structure 22, elongate member 26 will be in a generally upright position. In the illustrated embodiment, base member 24 is substantially planar and takes the form of a circular disk that extends radially outwardly from elongate member 26.

Anchorage surface 30 is provided with a sufficient area to inhibit the upward displacement of anchorage structure after installation of assembly 20 has been completed. Similarly, base surface 28 is provided with an area which is sufficiently large and spaced radially outwardly from elongate member 26 to prevent anchorage structure 22 from being blown over by the wind during installation prior to covering anchorage surface 30 with a fill material. It has been found that a base member 24 having a 5 inch (12.7 cm) outer diameter will provide adequate base and anchorage surfaces 28, 30 for most green roof systems.

The illustrated structure 22 is formed by injection molding a polymeric material such as nylon, polypropylene or other suitable material. In alternative embodiments, anchorage structure 22 may be formed out of a biodegradable material.

When installed, elongate member 26 extends through erosion mat 32 as seen in FIG. 1. Erosion mat 32 is a flexible sheet material having first and second major surfaces 34, 36. Erosion mats are well-known in the art and are typically a coarsely woven fabric which defines small open spaces between the interlaced strands of the erosion mat. Such erosion mats may be formed out of a polymeric material such as nylon or a more biodegradable material such as hemp or burlap. Wire mesh erosion mats can also be used. Such erosion control mats are well known to those having ordinary skill in the art. Conventional erosion mats will degrade within a year or two of exposure to the outside environment. The biodegradation of the erosion mat is often desirable, however, since the time required to biodegrade the erosion mat will generally be sufficient to allow a layer of vegetation 38 to be established. Vegetation 38 will then perform the erosion control function previously performed by erosion mat 32.

A retaining member 40 is secured to elongate member 26 to hold down erosion mat 32. The illustrated retaining members 40 are substantially planar and have a central opening 42. A plurality of flexible engagement members 44 extend radially inwardly within opening 42 similar to a timberman clip. Elongate member 26 is slightly larger than the space defined between engagement members 44 so that as elongate member 26 is inserted through opening 42 it is securely engaged and held by engagement members 44. Central opening 42 and engagement members 44 define a center gripping portion 46. Retaining member 40 extends radially outwardly from gripping portion 46 to define a circular outer perimeter 48. In the illustrated embodiment, outer perimeter 48 has a diameter of approximately 5 inches (12.7 cm). Although retaining member 40 and base member 24 each have the same outer diameter in the illustrated embodiment, alternative embodiments of the invention may have retaining members 40 and base members 24 that differ in size and/or configuration. The illustrated retaining members 40 are die cut from an integral piece of sheet metal material.

Figure 5:
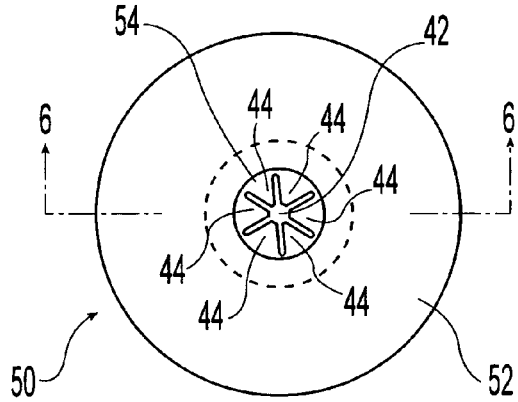
FIG. 5 is a top view of an alternative embodiment of a retaining member.
Figure 6:
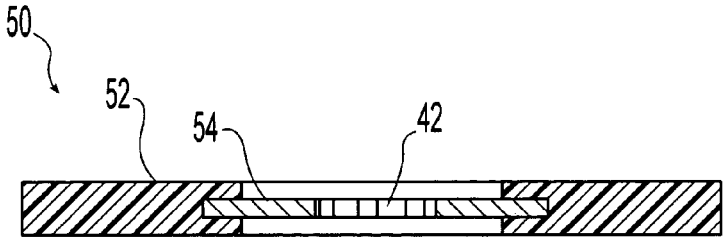
FIG. 6 is a cross sectional view taken along line 6-6 of FIG. 5.

Alternative retaining member 50, shown in FIGS. 5 and 6, has a radially outer polymeric portion 52 with an imbedded gripping portion insert 54. Retaining members 40, 50 are the same overall size and polymeric portion 52 has an outer diameter of approximately 5 inches (12.7 cm). The embedded gripping portion 54 has an outer diameter of approximately 1.5 inches (3.8 cm) and is a die cut sheet metal material. Gripping portion 54 includes a central opening 42 with engagement members 44 for securing an elongate member 26 within opening 42 in the same manner as retaining member 40. Alternative methods of securing retaining members 40, 50 to elongate members 26 may also be employed with the present invention. For example, retaining members 40, 50 and elongate members 26 could employ cooperative threads or ratcheting features to secure retaining members 40, 50 to elongate members 26. Retaining members 40 could also be made entirely of a polymeric material such as by injection molding and wherein the gripping portion 46 and engagement members 44 are made of the polymeric material.

Assembly 20 also includes a layer of material 56 containing a plant growing medium. After leveling the top surface 58 of material layer 56, erosion mat 32 is placed on material layer 56 with lower surface 36 of mat 32 engaging top surface 58 of layer 56 to thereby limit the loss of material from layer 56 due to the action of wind. Erosion mat 32 is held in place on top of layer 56 by the engagement of retaining members 40 with upper surface 34 of mat 32. The material forming layer 56 may be any material or soil suitable for growing plants. The illustrated layer 56 is an engineered soil. The use of engineered soils is common in green roof systems to provide a light weight growing medium for plants. Such soils often contain a mixture of aggregate and organic material. Engineered soils are commonly placed in layers of between 2 inches (5.1 cm) and 12 inches (30.5 cm) thick when installing green roof systems, however, a layer having a greater thickness may also be employed with the present invention. In the illustrated embodiment, the aggregate comprises 55% of the soil by volume and is an expanded slate material that has been kiln-fired. Such expanded slate aggregate has desirable water retention properties and also helps to maintain the structure of the engineered soil layer. Other material layers that provide a medium for rooting plants, however, may also be employed with the present invention.

A filter fabric 60 is located below material layer 56 and prevents material from layer 56 from clogging drainage layer 62. Filter fabrics for preventing the migration of fines into a drainage layer are well known in the art and filter fabric 60 used in assembly 20 is a conventional filter fabric. The drainage layer 62 is supported by roof structure 64. The drainage layer 62 may be a preexisting drainage feature of the roof structure or may be a drainage layer that is installed specifically for use with a green roof system. In the illustrated embodiment, drainage layer 62 is a conventional porous polymeric drainage mat that has been installed as a part of the green roof system. Such drainage mats may be formed out of a fused network of polymeric strands that define a network of interconnected pores and which can support the weight of the overlying materials without collapsing the interconnected pores. Alternative drainage layers, such as a layer of aggregate, may also be used to form drainage layer 62. Drainage layer 62 is placed over a water tight roof membrane for the purpose of draining water to a desired location such as the edge of the green roof system where it may be collected and discharged through the rain water drainage system of the building. When installing a green roof system on an existing building, the construction, condition and configuration of the existing roof will determine whether or not an additional water barrier will have to be installed on the roof structure 64 before installing drainage layer 62.

Figure 2:
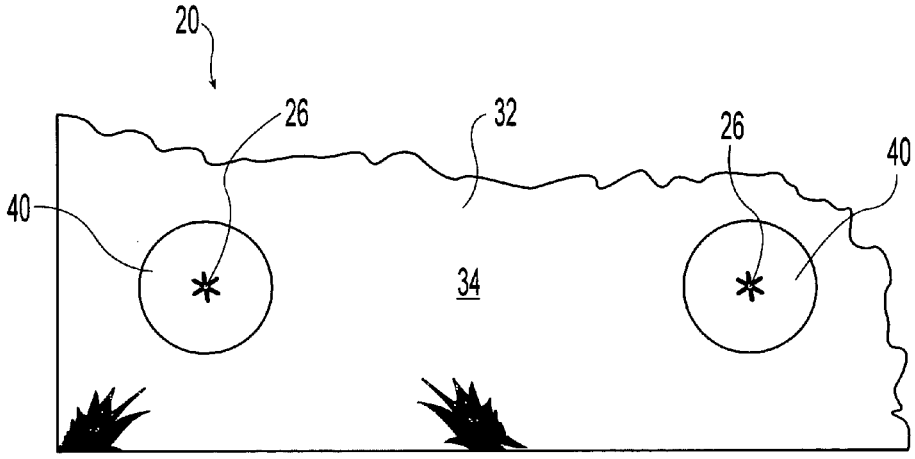
FIG. 2 is a plan view of the assembly of FIG. 1.
Figure 7:
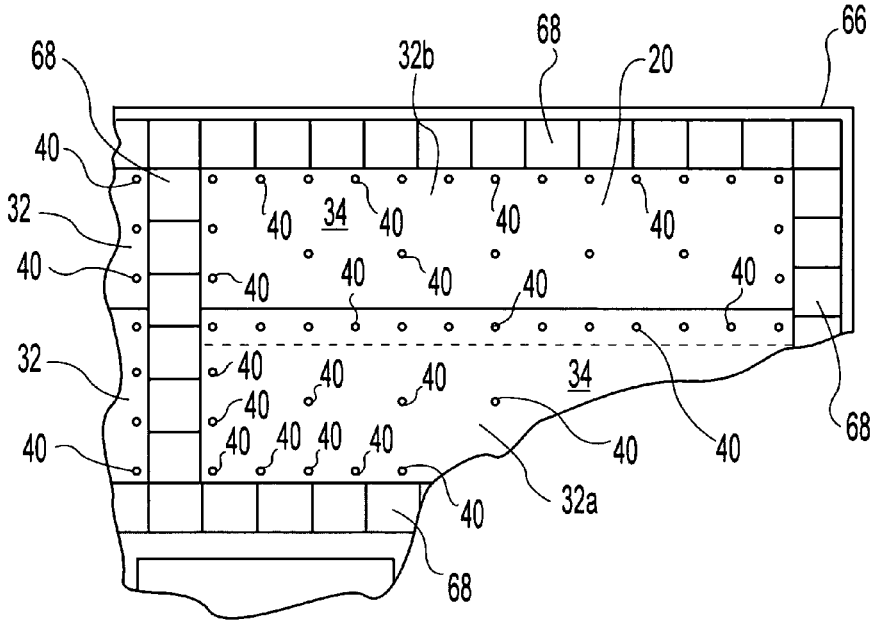
FIG. 7 is a plan view of a green roof system in accordance with the present invention.

As best understood with reference to FIGS. 1, 2 and 7, erosion mats 32 are secured with a plurality of anchorage structures 22 located at spaced apart intervals within material layer 56. Retaining members 40 are secured to each of the elongate members 26 projecting upwardly through erosion mats 32 to thereby securely hold erosion mats 32 in place on layer 56. In FIG. 7, a green roof installation on building 66 shows a first erosion mat 32*a* which overlaps a second erosion mat 32*b* located within an area bounded by concrete pavers 68.

Figure 8:
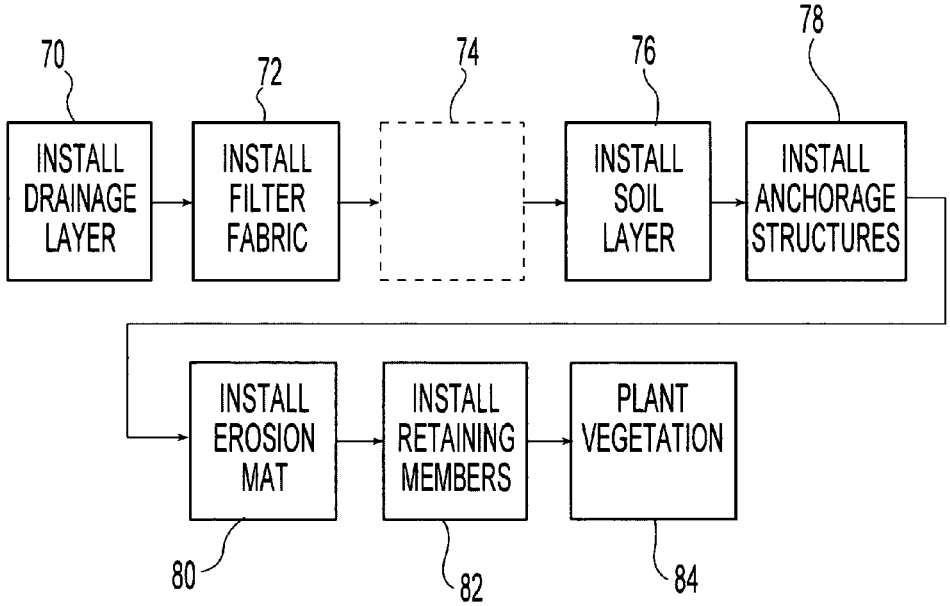
FIG. 8 is a flow chart describing the installation of a green roof system.

FIG. 8 provides a flow chart schematically depicting the installation of a green roof system employing the present invention. Box 70 represents the installation of drainage layer 62 on roof structure 64. As discussed above, this step may not be required for buildings which have a preexisting drainage layer that is well-suited for use with a green roof system. After the drainage layer 62 is in place, filter fabric 60 is installed over drainage layer 62 as represented by box 72.

After the filter fabric 60 is installed, the material layer 56 containing a plant growing medium is installed as represented by box 76. The engineered soil, or other suitable material, used to form layer 56 is evenly spread on filter fabric 60 and thereby holds filter fabric 60 in place. After installing material layer 56, anchorage structures 22 are installed as represented by box 78.

Anchorage structures 22 are installed by forming a depression 29 in material layer 56 as shown in FIG. 1 using dashed lines. Depression 29 allows base surface 28 of anchorage structure 22 to be placed proximate filter fabric 60. The depression 29 may be formed by using a shovel or similar tool. Alternatively, anchorage structure 22 may be used as a digging tool with base member 24 being used to simultaneously form depression 29 and "slide" base member 24 downwardly into material layer 56 and into its desired location. After placing anchorage structure 22 in its desired position, a fill material 57 is placed in depression 29 around anchorage structure 22 to engage anchorage surface 30 and thereby inhibit the upward displacement of anchorage structure 22. Fill material 57 may be a different material than that used to form material layer 56, e.g., an aggregate backfill. In the illustrated embodiment, the same material used to form material layer 56 is used as fill material 57.

The weight of fill material 57 above anchorage surface 30 secures anchorage structures 22 in place within material layer 56. After installation, winds may generate an uplifting force on erosion mats 32 and a sufficient number of anchorage structures 22 and retaining members 40 must be used to resist these anticipated wind loads. Using a heavier fill material 57 or anchorage structures 22 with larger anchorage surfaces will enable anchorage structures 22 to resist larger wind loads. In FIG. 1, filter fabric 60 and upper surface 58 of material layer 56 are both horizontally oriented. The illustrated embodiment, however, may also be used in applications where filter fabric 60 and upper surface 58 of material layer 56 are at moderate slopes but are still sufficiently horizontal such that there is sufficient fill material 57 located above anchorage surfaces 30 to firmly anchor structures 22 within material layer 56.

Anchorage structures 22 may alternatively be positioned on filter fabric 60 prior to the installation of material layer 56 as represented by dashed box 74. When installing the green roof system in this order, anchorage structures are set on filter fabric 60 at their desired locations and then material layer 56 is filled in around anchorage structures 22. In such an installation, material layer 56 is advantageously used to form the fill material 57 that lies directly proximate each anchorage structure 22 and bears downwardly on anchorage surfaces 30.

After both the material layer 56 and anchorage structures 22 have been installed, erosion mat 32 is placed on the upper surface 58 of material layer 56 as represented by box 80. The ends 25 of elongate members 26 projecting above the material layer 56 are then pushed and inserted through holes in the erosion mat 32. More particularly, the ends 25 of elongate members 26 are pushed through the open spaces existing between the interlaced strands of the erosion mat. Retaining members 40 are then installed on the ends of elongate members 26 that project upwardly through erosion mat 32 as represented by box 82. Installing retaining members 40 is a simple procedure that involves placing the retaining members 40 over the elongate members 26 so that members 26 are inserted through openings 42. Retaining members 40 are pushed firmly downward to engage the upper surface 34 of erosion mat 32 proximate elongate member 26 to thereby hold erosion mat 32 with its lower surface 36 in contact with the upper surface 58 of material layer 56. After the retaining member 40 has been secured to the elongate member 26, the excess length of elongate member 26 extending above retaining member 40 can be removed such as by cutting off the excess length with a pair of plyers, clippers or other cutting tool. Advantageously, less than approximately 1 inch (2.5 cm) of elongate member 26 will remain projecting above retaining member 40 after removing the excess length of elongate member 26.

Box 84 represents the planting of vegetation in material layer 56. After erosion mat 32 has been secured in place, vegetation 38 is planted in material layer 56 through the openings in coarsely woven erosion mat 32. The vegetation 38 may advantageously be seedling plants chosen for the climate in which the building is located. As the vegetation matures, it will begin to perform the erosion inhibiting function initially performed by erosion mat 32. Although only one plant 38 is depicted in FIG. 1, the entire expanse of material layer 56 would be planted with vegetation. In some embodiments, it may also be possible to either seed or plant seedlings in material layer 56 after installing material layer 56 and prior to placing erosion mat 32 thereover. In such embodiments, box 84 would be positioned between boxes 76 and 80.

While this invention has been described as having an exemplary design, the present invention may be further modified within the spirit and scope of this disclosure. This application is therefore intended to cover any variations, uses, or adaptations of the invention using its general principles.

What is claimed is:

1. A green roof assembly for inhibiting wind erosion, said assembly comprising:

a material layer including a plant growing medium;

an erosion mat overlaying said material layer;

an anchorage structure having an anchorage surface and a rigid elongate member, said anchorage surface being disposed within said material layer and inhibiting upward displacement of said anchorage structure by engagement with said material layer, said elongate member extending out of said material layer and through said erosion mat; and a retaining member secured to said elongate member and engaging said erosion mat.

2. The assembly of claim 1 wherein said anchorage structure includes a substantially planar base member extending radially outwardly from said elongate member, said base member defining a downwardly facing base surface, said anchorage surface being defined by an upwardly facing surface of said base member, said anchorage structure being supportable with said elongate member in a generally upright position by engagement of said base surface with a generally horizontal surface.

3. The assembly of claim 1 wherein said retaining member is a substantially planar member having an opening, said elongate member extending through and being secured within said opening.

4. The assembly of claim 3 wherein said anchorage structure includes a substantially planar base member extending radially outwardly from said elongate member, said base member defining a downwardly facing base surface, said anchorage surface being defined by an upwardly facing surface of said base member, said anchorage structure being supportable with said elongate member in a generally upright position by engagement of said base surface with a generally horizontal surface.

5. The assembly of claim 4 wherein said base member comprises a substantially circular disk.

6. The assembly of claim 5 wherein said retaining member comprises a disk having a substantially circular outer perimeter and wherein each of said base member and said retaining member define substantially equivalent outer diameters.

7. The assembly of claim 1 wherein said retaining member comprises a gripping portion securely engageable with said elongate member, said gripping portion including at least one engagement member projecting radially inwardly within said opening, said engagement member being securely engageable with said elongate member.

8. The assembly of claim 1 wherein said elongate member comprises a polymeric material.

9. The assembly of claim 8 wherein said retaining member comprises a gripping portion securely engageable with said elongate member, said gripping portion comprising a sheet metal material defining an opening with at least one engagement member projecting radially inwardly within said opening, said engagement member being securely engageable with said elongate member.

10. The assembly of claim 9 wherein said retaining member is formed from an integral piece of sheet metal material.

11. The assembly of claim 9 wherein said retaining member comprises a polymeric portion having said gripping portion embedded therein, said polymeric portion extending radially outwardly of said gripping portion.

12. The assembly of claim 1 including a plurality of said anchorage structures and a corresponding plurality of said retaining members, said elongate member of each of said anchorage structures extending upwardly through said erosion mat at spaced apart intervals and wherein a respective one of said plurality of retaining members is secured to each of said elongate members, each of said plurality of retaining members being engaged with said erosion mat.

13. The assembly of claim 1 wherein said assembly is adapted for installation on a roof structure and further comprises:

a drainage layer disposed vertically above the roof structure;

a filter fabric disposed between said drainage layer and said material layer; and wherein said anchorage structure is positioned above said filter fabric.

* * * * *